United States Patent [19]

Barofsky

[11] 3,936,532

[45] Feb. 3, 1976

[54] ACTIVATION OF THIN WIRE EMITTERS FOR FIELD IONIZATION/FIELD DESORPTION MASS SPECTROMETRY

[75] Inventor: Douglas F. Barofsky, Portland, Oreg.

[73] Assignee: Oregon Graduate Center for Study and Research, Beaverton, Oreg.

[22] Filed: Feb. 8, 1974

[21] Appl. No.: 440,826

[52] U.S. Cl. ..... 427/111; 148/6.3; 313/340; 313/345; 427/116; 427/120

[51] Int. Cl.[2] ..... B05D 5/12

[58] Field of Search ..... 117/231, 213, 118, 62, 117/49, 106 R; 148/6.3; 313/345, 340; 427/111, 116, 120

[56] References Cited

UNITED STATES PATENTS

| | | | |
|---|---|---|---|
| 1,699,639 | 1/1929 | Van Gessel | 148/6.3 |
| 2,151,797 | 3/1939 | Prescott, Jr. | 117/49 |
| 2,161,790 | 6/1939 | Abadie | 148/6.3 |
| 3,345,218 | 10/1967 | Brookover et al. | 148/6.3 |
| 3,401,297 | 9/1968 | Feinleib | 313/340 |
| 3,450,565 | 6/1969 | Theodosupoulos et al. | 313/340 |

*Primary Examiner*—Mayer Weinblatt
*Attorney, Agent, or Firm*—Kolisch, Hartwell, Dickinson & Stuart

[57] ABSTRACT

Improved, more reliable activation of a thin wire emitter for field ionization and field desorption mass spectrometry is provided by controlled preroughening of the emitter wire prior to growing semiconducting microneedles on the wire surface.

10 Claims, 7 Drawing Figures

ACTIVATION OF THIN WIRE EMITTERS FOR FIELD IONIZATION/FIELD DESORPTION MASS SPECTROMETRY

BACKGROUND AND OBJECTS OF THE INVENTION

The present invention relates to mass spectrometry, and more particularly to field ionization and field desorption mass spectrometry.

Field ionization (FI) and field desorption (FD) mass spectrometry are increasingly important techniques for studying thermally unstable organic molecules, especially those which are biologically important. With either technique, positive ions of a meterial being analyzed are generated by exposing the material to a high magnitude electric field (of the order of $10^7$–$10^8$ V/cm). Of the various types of field anodes or emitters which have been used for producing such fields, including single sharp metal points, sharp metal edges, and activated thin wires, the latter have proved most suitable.

"Activation," as the term is used herein, is the production of a substantial number of semiconducting microneedles on the surface of a field anode to provide local field enhancement. The microneedles are grown on the emitter by field polymerization or field pyrolysis of an organic compound, usually benzonitrile. For FI work, densely activated, short needle (~1 um) emitters are considered preferable, but for FD work, emitters having much longer needles (10–25 um) are used.

Several methods for activating thin metal wires are known. Room temperature activation has been described, for example, by Beckey et al. in Messtechnik, 79, (1971) 196–201. Activation at considerably higher temperatures (1200°C.) has been detailed by Beckey et al. in J. Phys. E: Scientific Instruments, 6, (1973) 1040–44. High temperature activation is considered superior, since the microneedles produced at high temperature have a higher thermal stability, much higher resistance to chemical attack, and a reduced tendency to yield to high electric field stresses.

Attempts to produce activated thin wire emitters using prior art methods have met with many difficulties, particularly in initiating the desired dense, uniform needle growth. In many instances, activation did not proceed at all, and when microneedles were produced, they were sparsely distributed in tufts over the surface of the wire. Good emitters are essential to the operation of an FI/FD ion source, and the development of FD mass spectrometry in particular has been inseparably linked to improvements in the technique for making field anodes.

There is a need, therefore, for an improved method for reliably producing activated thin wire emitters for field ionization and field desorption mass spectrometry.

A general object of the present invention is to provide a method which meets the above-identified need in a practical and satisfactory manner.

A more specific object of the invention is to provide a method for reproducibly growing microneedles on thin wire field anodes.

A related object of the invention is to provide improved, activated thin wire emitters for FI/FD mass spectrometry.

SUMMARY OF THE INVENTION

These and other objects of the present invention are accomplished by a method for producing activated thin wire emitters which comprises uniformly preroughening the surface of the emitter wire prior to activation. In a preferred practice of the invention, the emitter wire is preroughened by alternate oxidation and reduction of the wire surface. Controlled preroughening by the method of the invention produces a large number of uniformly distributed sites for the initiation of needle growth during subsequent activation.

After preroughening, the wire, suitably a tungsten wire having a diameter of about 5–10 $\mu$m, is activated at high temperature. Needle growth initiates and proceeds readily on the preconditioned surface, and a uniform, dense growth of semiconducting microneedles results.

BRIEF DESCRIPTION OF THE DRAWINGS

The novel method of the invention will be more fully explained by the following detailed description and the accompanying drawings, wherein.

DETAILED DESCRIPTION OF THE INVENTION

Figure 1:
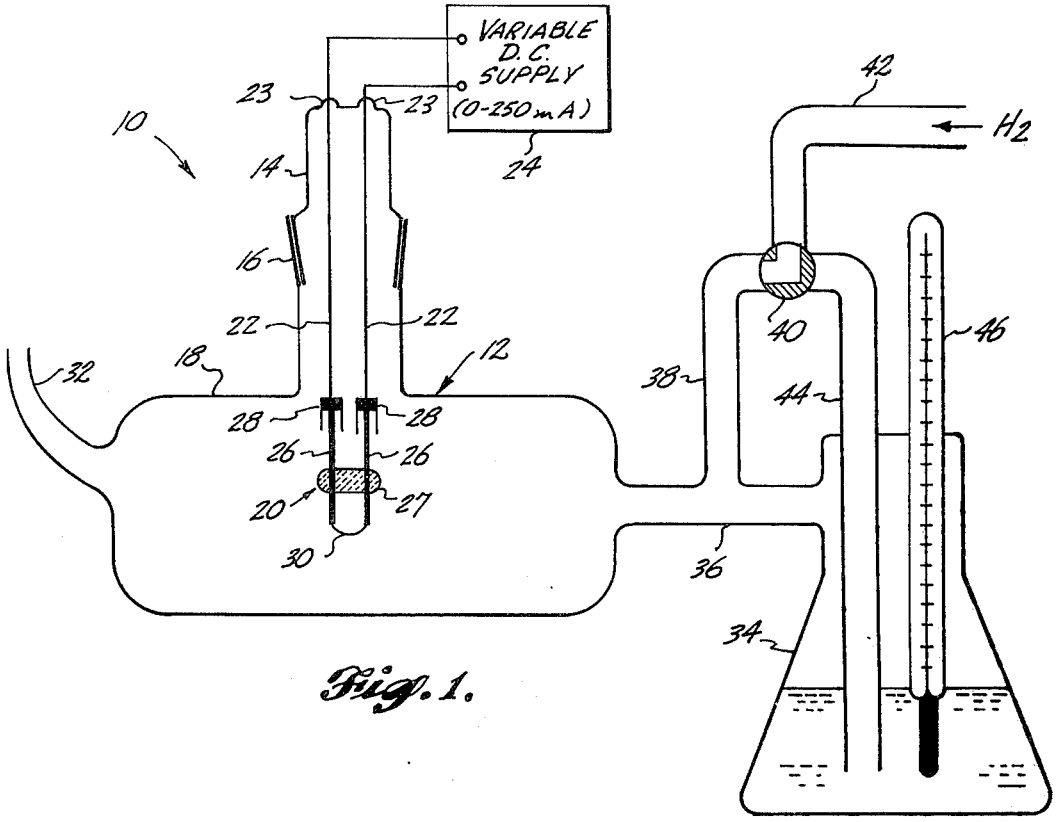
FIG. 1 is a schematic illustration of apparatus used for uniformly preroughening an emitter wire.

Describing now a preferred embodiment of the invention, and referring first to FIG. 1 of the drawings, apparatus for preroughening the surface of an emitter wire prior to activation is indicated generally at 10. The apparatus includes an oxidation-reduction cell 12 having a removable cap 14 joined to the cell's main body 18 by a ground joint 16. An emitter holder 20 is supported within the central portion of body 18 by a pair of conductive leads 22 extending through suitable seals 23 at the top of cap 14. The leads are connected outside the cell to the output terminals of a direct current power supply 24. Power supply 24 suitably is a variable voltage regulated supply having a current capacity of about 250 milliamps.

Emitter holder 20 includes a pair of rigid support electrodes 26 embedded in and held apart a suitable distance by a glass spacer 27. In the actual practice of the invention, the support electrodes have a spacing of about 4.5 mm. An emitter wire 30 is attached, as by spot welding, to the electrodes at one end of holder 20, the lower end in the drawings. At the other end, the electrodes are detachably fastened to leads 22 by suitable connectors 28, facilitating the rapid interchange of emitter-bearing holders in cell 12.

Cell body 18 is provided at one end, the left end in FIG. 1, with an upturned gas outlet spout 32. The other end of body 18 is connected to the neck of a sealed flask 34 by a tube or line 36. Teeing into line 36 is a line 38 connected to one outlet of a conventional two-way stopcock 40. The inlet of stop-cock 40 is connected to a suitable source (not shown) of pure hydrogen by a line 42. A line 44 connected to the stopcock's other outlet extends through a seal in the top of flask 34 to a location just above the bottom of the flask, as shown.

Flask 34 is partially filled with distilled water, as indicated in FIG. 1. Heater means (not shown) is provided for maintaining the water at a desired temperature, indicated by a sealed-in thermometer 46.

As will be apparent, with stopcock 40 turned to the position indicated in FIG. 1, hydrogen gas will flow into cell 12 from line 42 through lines 38 and 36. With the stopcock turned 90° clockwise, hydrogen will flow into flask 34 through line 44, bubble through the water in the flask, then flow into the cell through line 36. In either case, after passing through the body of the cell the gas escapes through spout 32. For safety, the gas is ignited at the open end of the spout by a pilot flame (not shown).

Figure 3:
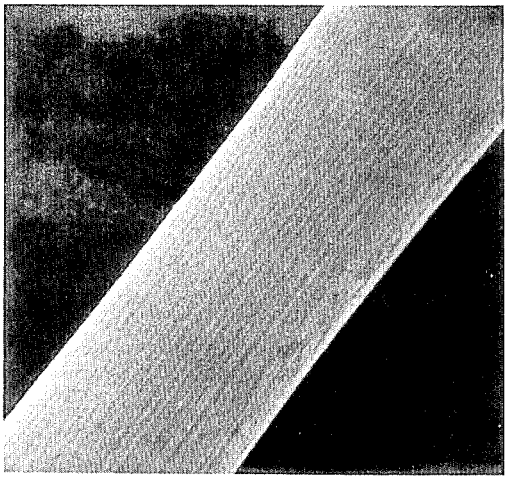
FIGS. 3–7 are micrographs depicting an emitter wire at different stages during preroughening and activation according to the invention.

In the preferred practice of the invention, FI/FD emitters are made from tungsten wire having a diameter of about 5–10 $\mu$m, preferably about 8 $\mu$m. Suitable wire is commercially available from A. D. Mackay, Inc., 198 Broadway, New York, N. Y. 10038. As supplied, this wire has a relatively smooth surface, as shown in FIG. 3, a scanning electron microscope (SEM) micrograph of an untreated portion of the wire. The striation visible in the micrograph is caused by the wire manufacturing process.

After a length of 8 $\mu$m tungsten wire has been spot welded between the support electrodes of an emitter holder, the wire is cleaned in alcohol, and the holder mounted in an oxidation-reduction cell, as shown in FIG. 1. Air is swept from the system, and stopcock 42 turned to the position shown to establish a flow of pure hydrogen through the cell.

Initially, the surface of the wire is cleaned by high temperature reduction in the pure hydrogen atmosphere of cell 12. Using power supply 24, current is passed through the wire to heat it to about 1100°–1300°C. for about 1–5 minutes. Reduction at about 1300°C. ($\gamma$200 mA) for about 1–2 minutes is preferred in practice.

Figure 4:
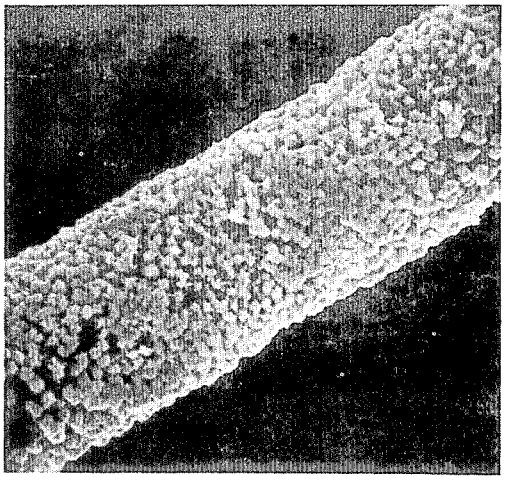

Next, the temperature of the emitter wire is reduced to about 750°C. (165–175 mA), and the surface oxidized by briefly flushing the cell with a hydrogen-water vapor mixture. This is accomplished by rotating stopcock 42 clockwise 90° to allow an aliquot of hydrogen to bubble through the water in flask 34, then immediately rotating it back 90° (counterclockwise) to reestablish the flow of pure hydrogen. The water in flask 34 is maintained at a temperature of about 70°–90°C., preferably about 85°C. At this stage, the middle portion (about 3 mm) of the emitter wire will be covered with a characteristic matte gray-black oxide layer. Microscopic examination of the wire reveals a uniform granular surface, shown in the FIG. 4 SEM micrograph.

Figure 5:
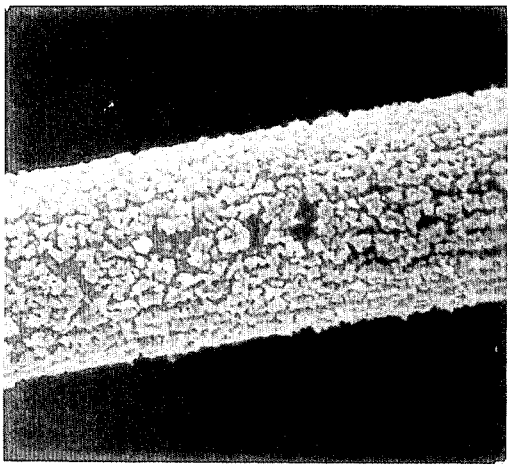

Finally, the gray-black oxide is reduced to the parent metal by repeating the reduction step, i.e., the wire temperature is again raised to 1100°–1300°C. for 1–5 minutes in a pure hydrogen atmosphere. The result is a wire having a uniformly roughened surface, as shown in the FIG. 5 micrograph, providing a large number of sharp bumps and edges for the initiation of microneedle growth under subsequent activation.

Figure 2:
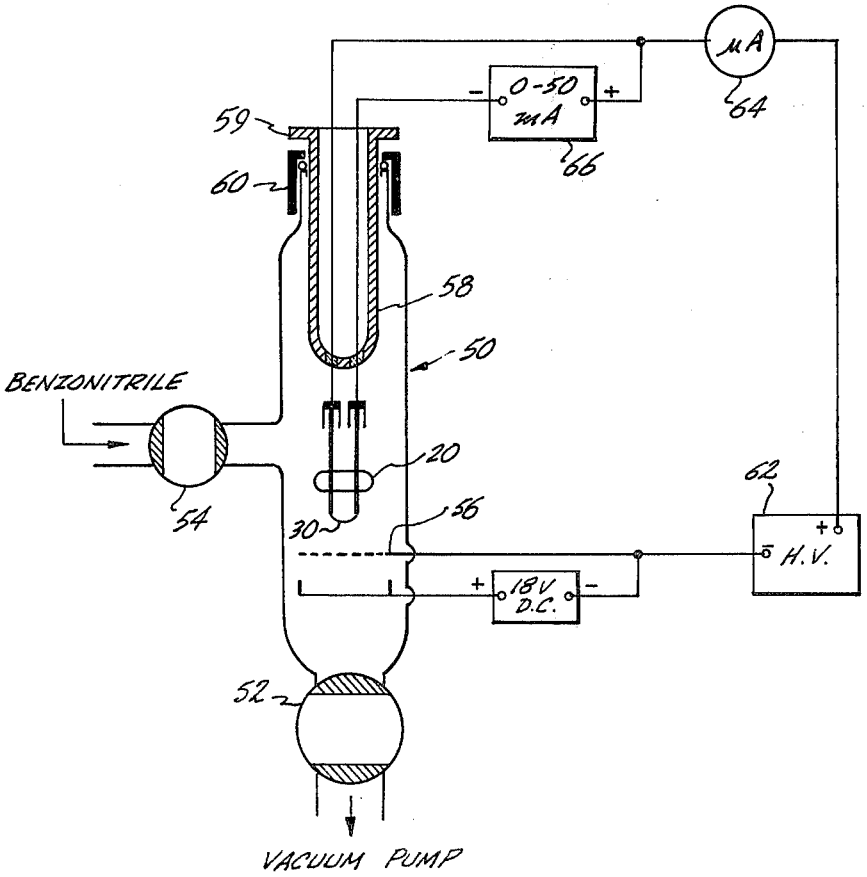
FIG. 2 is a schematic illustration of apparatus used to activate a preroughened wire.

Referring now to FIG. 2, the activation apparatus shown therein is conventional, having been described, for example, by Beckey et al. in Messtechnik 79, (1971) pp 196–201. The apparatus includes an activation cell 50 connected through a valve 52 to a suitable vacuum pump (not shown), and through a valve 54 to a container (not shown) holding a supply of benzonitrile. An emitter holder 20 mounting an emitter wire 30 is supported in the cell above a mesh cathode 56 by a hollow metal finger 58. The finger includes a flange 59 which seats against a vacuum seal 60 during activation. Cathode 56 is connected to the negative terminal of a suitable high voltage power supply 62. The positive terminal of supply 62 is connected through a microammeter 64 to the emitter holder. A low-voltage, variable direct current power supply 66 is connected to holder 20 as shown, for heating the emitter wire during activation.

Describing briefly the high-temperature activation procedure, after a preroughened tungsten emitter wire 30 has been mounted in cell 50, the cell is evacuated, then filled with benzonitrile vapor at a pressure of about $10^{-2}$ Torr. The temperature of the emitter wire is raised to about 1200°C. (about 28mA), then power supply 62 is activated to apply high voltage to the heated wire. A potential of 10 kV is applied initially. The pressure of the benzonitrile vapor is regulated using valves 52 and 54 so that it is just below the point where a glow discharge occurs in the activation cell.

Figure 6:
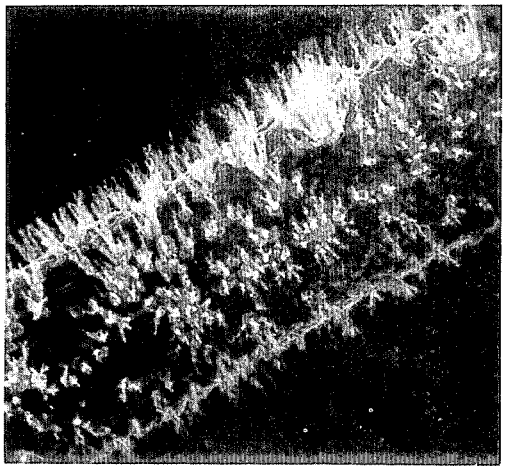

Activation initiates and proceeds readily on the uniformly roughened surface. FIG. 6 depicts the growth of microneedles on the surface of wire 30 after an activation time of about 20 minutes. As is apparent from the micrograph, needle growth initiates on surface protrusions provided by the preroughening treatment.

The density of microneedle growth depends on the intial applied electric field and on subsequent changes in the field during activation. For a 8 $\mu$m wire, the field strength at 10 kV is sufficient for activation to proceed at a majority of the surface protrusions, and a dense growth is initiated. At lower voltages, activation takes place only at the sharper sites, producing a less dense growth. Similarly, if, during activation, the voltage is lowered, growth proceeds further only on the sharpest needles. In general, growth to a substantially uniform needle length of about 13 $\mu$m occurs within a period of 3 to 4 hours.

Figure 7:
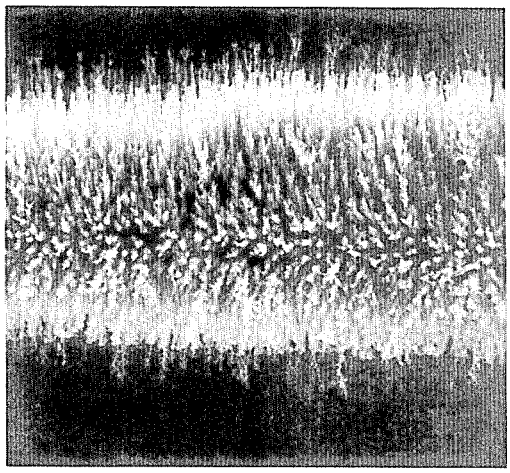

In order to compensate for cooling of the needle tips as they increase in length, as well as to extend the growth region over a larger portion of the wire, the temperature of the emitter is raised by increasing the heating current about 2 mA/hr during the activation period. FIG. 7 depicts an emitter wire activated at 10 kV for 3 hours, during which time the heating current was raised from 28 to 34 mA. As shown, needle growth is quite uniform, but extremely dense. Less dense growths aare achieved by reducing the high voltage over a period of time to about 5 kV after about one-half to one hour initiation time at the higher voltage. Needle density appears to be inversely proportional to the rate of this voltage decrease. In any event, the distribution of semi-conducting microneedles is quite uniform.

The uniformity of microneedle distribution over the surface of the emitter wire is attributable directly to the uniformity of the preroughening treatment. Although the oxidation-reduction technique detailed above reproducibly yields uniformly roughened surfaces, needle growth will initiate on surface protrusions irrespective of how they are produced. Growth has been initiated, for example, on the rough oxidized surface of a tungsten wire, such as that shown in FIG. 4. However, since the oxide is not strongly adhered to the tungsten substrate, needles produced in this manner detach from the wire too easily under field stress. In preroughening tungsten emitter wires by the oxidation-reduction method of the invention, overoxidation should be avoided. The proper degree of oxidation is primarily dependent on the temperature of the emitter wire during exposure to the hydrogen-water vapor mixture. The optimum temperature is about 750°C., just below the lowest temperature which can be measured by optical pyrometry. In practice, the temperature is determined by extrapolating below the optical pyrometer limit a plot of emitter resistance versus temperatures measured above the limit. If the emitter temperature is too low during the oxidation step, no visible oxidation will occur. Just below the proper temperature range, a blue-black oxide layer will be formed over most of the wire. As the temperature is increased slightly, a small portion at the center of the wire will attain the desired matte gray-black appearance. The oxidation can be extended to cover about 3 mm of the emitter length by yet another small increase in temperature. However, if the temperature is increased beyond this point in an effort to lengthen the oxide zone further, the central portion of the wire will become too hot, rapidly overoxidize, and burn through.

The oxidation step depends less critically on the temperature of the water in flask 34 and the length of exposure to the hydrogen-water vapor atmosphere. The correct exposure time can be easily determined emperically. Although a preferred embodiment of the invention has been described herein, it is understood that variations and modifications are possible without departing from the spirit of the invention. For example, the preroughening method is applicable to emitter wires made of materials other than tungsten, and other methods of activation, such as room temperature activation, may be employed.

It is claimed and desired to secure by letters patent:

1. In the manufacture of an activated wire field anode for field ionization and field desorption mass spectrometry by a method including the activation of a tungsten wire, the improvement comprising the preactivation steps of providing a substantially uniform granular oxide surface layer on the wire, and reducing the oxide layer to the parent metal, yielding a substantially uniformly roughened surface.

2. The improvement of claim 1, wherein said oxide surface layer is provided by exposing said wire at an elevated temperature to a moisture-bearing hydrogen atmosphere.

3. The improvement of claim 1, wherein said oxide layer is reduced by exposure at an elevated temperature to an atmosphere of hydrogen.

4. The improvement of claim 1, wherein said preactivation steps comprise exposure of said wire at an elevated temperature to a moisture-containing atmosphere, followed by exposure at an increased temperature to a dry hydrogen atmosphere.

5. An improvement in the manufacture of an activated wire field anode for field ionization and field desorption mass spectrometry by a method including the step of activating the surface of a tungsten wire, comprising the preactivation steps of providing said surface with a substantially uniform gray-black oxide layer, and reducing said layer to the parent metal, yielding a substantially uniformly roughened tungsten surface.

6. The improvement of claim 5, wherein said gray-black oxide layer is provided by heating said wire to a temperature of about 750°C. and exposing the heated wire to a water vapor-bearing atmosphere.

7. The method of claim 5, wherein said oxide layer is reduced by heating said wire to a temperature of about 1100°–1300°C. in a pure hydrogen atmosphere.

8. An impovement in the manufacture of an activated wire field anode for field ionization and field desorption mass spectrometry by a method including the activation of a tungsten wire, comprising the preactivation steps of exposing said wire at an elevated temperature to a moisture-containing hydrogen atmosphere to provide a substantially uniform gray-black oxide layer thereon, and reducing said layer to the parent metal by exposure at an increased temperature to a dry hydrogen atmosphere, whereby a substantially uniformly roughened tungsten surface is provided on the wire.

9. The improvement of claim 8, wherein said elevated temperature is a temperature of about 750°C.

10. The method of claim 9, wherein said increased temperature is a temperature of about 1100°–1300°C.

* * * * *